US005669326A

United States Patent [19]

Ikeda

[11] Patent Number: 5,669,326

[45] Date of Patent: Sep. 23, 1997

[54] WATERCRAFT

[75] Inventor: Keijiro Ikeda, Iwata, Japan

[73] Assignee: Yamaha Hatsudoki Kabushiki Kaisha, Iwata, Japan

[21] Appl. No.: 593,669

[22] Filed: Jan. 29, 1996

[30] Foreign Application Priority Data

Jan. 27, 1995 [JP] Japan ..... 7-011892

[51] Int. Cl.[6] ..... B63B 17/00

[52] U.S. Cl. ..... 114/363; 114/270

[58] Field of Search ..... 114/361, 363, 114/270; 440/38

[56] References Cited

U.S. PATENT DOCUMENTS 5,218,922 6/1993 Kobayashi ..... 114/363

5,237,950 8/1993 Abe et al. ..... 114/363

5,438,946 8/1995 Kobayashi ..... 114/363

*Primary Examiner*—Stephen Avila

*Attorney, Agent, or Firm*—Knobbe, Martens, Olson & Bear LLP

[57] ABSTRACT

A number of embodiments of small watercraft wherein at least a portion of the propulsion system is disposed beneath a longitudinally extending raised seat that is adapted to accommodate at least a pair of riders seated in straddle tandem fashion or a rider-operator in two different longitudinal positions. The engine for the watercraft, which may be a V-type engine in some embodiments, is positioned at least in part beneath the seat and may accessed for servicing through an access opening closed by a removable cushion portion of the seat. The access opening is not large enough to permit removal of the engine, but a further access opening is formed through which the engine may be removed.

30 Claims, 11 Drawing Sheets

WATERCRAFT

BACKGROUND OF THE INVENTION

This invention relates to a watercraft and more particularly to an improved, small personal-type watercraft.

A type of watercraft known as a "personal watercraft" is quite popular and its popularity continues to grow. This type of watercraft is quite compact in nature and is also very sporting. The watercraft is designed to be operated and ridden primarily by a single rider-operator. Many of these watercraft, however, provide an arrangement wherein more than one rider may ride on the watercraft.

A common seating configuration which is utilized has a longitudinally extending straddle-type seat on which the rider and his passenger sit. The seat generally has sufficient length so that the rider-operator may shift his position to accomplish different types of watercraft handling or, if passengers are accommodated, they are seated in straddle tandem fashion.

Because of the small and compact nature of these watercraft, the placement of the various components, such as the engine and propulsion device, present particular problems. In one type of arrangement, the engine is positioned forwardly of the seat and beneath the controls. This type of placement has the advantage in that it easier to install and remove the engine and also to service the engine. However, because of the nature of these watercraft, the balance with a front disposed engine may be less than desirable. This is particularly true when different numbers of passengers are carried. The balance may be all right for one passenger arrangement, but not for another.

Therefore, there are some advantages in placing the engine beneath the seat and in a longitudinally center position in the watercraft. In this way, the balance of the watercraft tends to be more stable regardless of the number of riders and also regardless of the seating position which the rider-operator chooses. Of course, by positioning the engine under the seat, then the accessibility and installation of removal of the engine becomes a problem.

It is, therefore, a principal object of this invention to provide an improved watercraft, engine and seating construction wherein the engine is accessible and can be easily removed and installed while good balance can be maintained.

It is a further object of this invention to provide an improved seating and engine compartment arrangement for a watercraft wherein the engine can be placed beneath the rider seat, can be easily serviced and may be installed and removed.

With the type of seating arrangement described, i.e., that using a straddle tandem-type seat, it is desirable to maintain the elevated portion of the seat relatively narrow. As the width of the seat base becomes greater, the riding position of the passengers can become more uncomfortable. Therefore, it is desirable to maintain a seat arrangement that is relatively narrow in the transverse direction. However, this dictates generally the use of in-line engines and requires the engine to be placed in a generally upright position beneath the seat. Also, this presents certain problems when utilizing four-cycle engines wherein the induction and exhaust system may be positioned high in the engine rather than low as with a two-cycle engine.

Also, it is desirable to provide more compact V-type engines for these watercraft. If a V-type engine is employed, then the longitudinal length of the engine can be minimized, and this further improves in the weight balance situation. However, if a V-type engine is positioned beneath the seat, then accessibility, particularly for removal and installation, becomes complicated.

It is, therefore, a still further object of this invention to provide an improved hull and seating arrangement for a small watercraft wherein wide engines can be accommodated and installed and removed without necessitating undue widening of the seat base.

Another design problem in conjunction with personal watercraft is the provision of adequate storage compartments for the rider and passengers to carry personal belongings and other articles. The space constraints with this type of watercraft should be readily apparent from the foregoing description. It is obviously desirable to provide storage compartments of adequate capacity and which are also effectively sealed.

It is, therefore, a still further objection of this invention to provide and improved watercraft that will provide adequate storage capacity without interfering with the serviceability or access of other watercraft components.

It is a further object of this invention to provide an improved storage compartment and engine access arrangement for a watercraft wherein adequate storage is provided, the engine can be easily accessed for servicing and the engine can be installed and removed without necessitating disassembly of the engine within the watercraft and all also without requiring abnormally large access opening particularly in the rider's area.

SUMMARY OF THE INVENTION

A first feature of this invention is adapted to be embodied in a small watercraft which is comprised of a hull that defines a rider's area. The rider's area has a raised seat portion that is adapted to accommodate at least one rider. An engine compartment is formed in the hull at least in part beneath the raised seat portion. An internal combustion engine is supported within the engine compartment. A propulsion for propelling the hull is supported by the hull and is driven by the internal combustion engine. The raised seat portion is formed with a service access opening through which at least one component of the engine may be accessed for servicing. A first removable closure detachably covers the service access opening. The service access opening is not large enough to pass the engine as a unit therethrough. A further replacement access opening is formed in the hull at a location spaced from the service access opening and through which the internal combustion engine may pass a unit. A second removable closure closes the replacement access opening.

A further feature of the invention is also adapted to be embodied in a small watercraft that is comprised of a hull that defines a rider's area. In connection with this feature, the rider's area has a longitudinally extending raised seat portion that is adapted to accommodate at least one rider seated thereon in a straddle fashion. A pair of foot areas are formed on opposite sides of the raised seat portion and on which a seated rider may place his feat. The watercraft is provided with a propulsion system that is comprised of an internal combustion engine, a propulsion device for propelling the hull and a transmission for driving the propulsion device from the engine. At least a portion of the propulsion system is disposed beneath the raised seat portion. An access opening is formed in an upper surface of the raised seat portion and through which at least a portion of the propulsion system may be accessed for servicing. A further opening is formed in the upper surface of the raised seat portion for accommodating a storage compartment. A first seat cushion portion is detachably connected to the raised seat portion and forms a closure for the access opening. A second seat cushion portion is detachably connected to the raised seat portion for forming a closure for the further opening formed therein.

DETAILED DESCRIPTION OF THE PREFERRED EMBODIMENTS OF THE INVENTION

Figure 1:
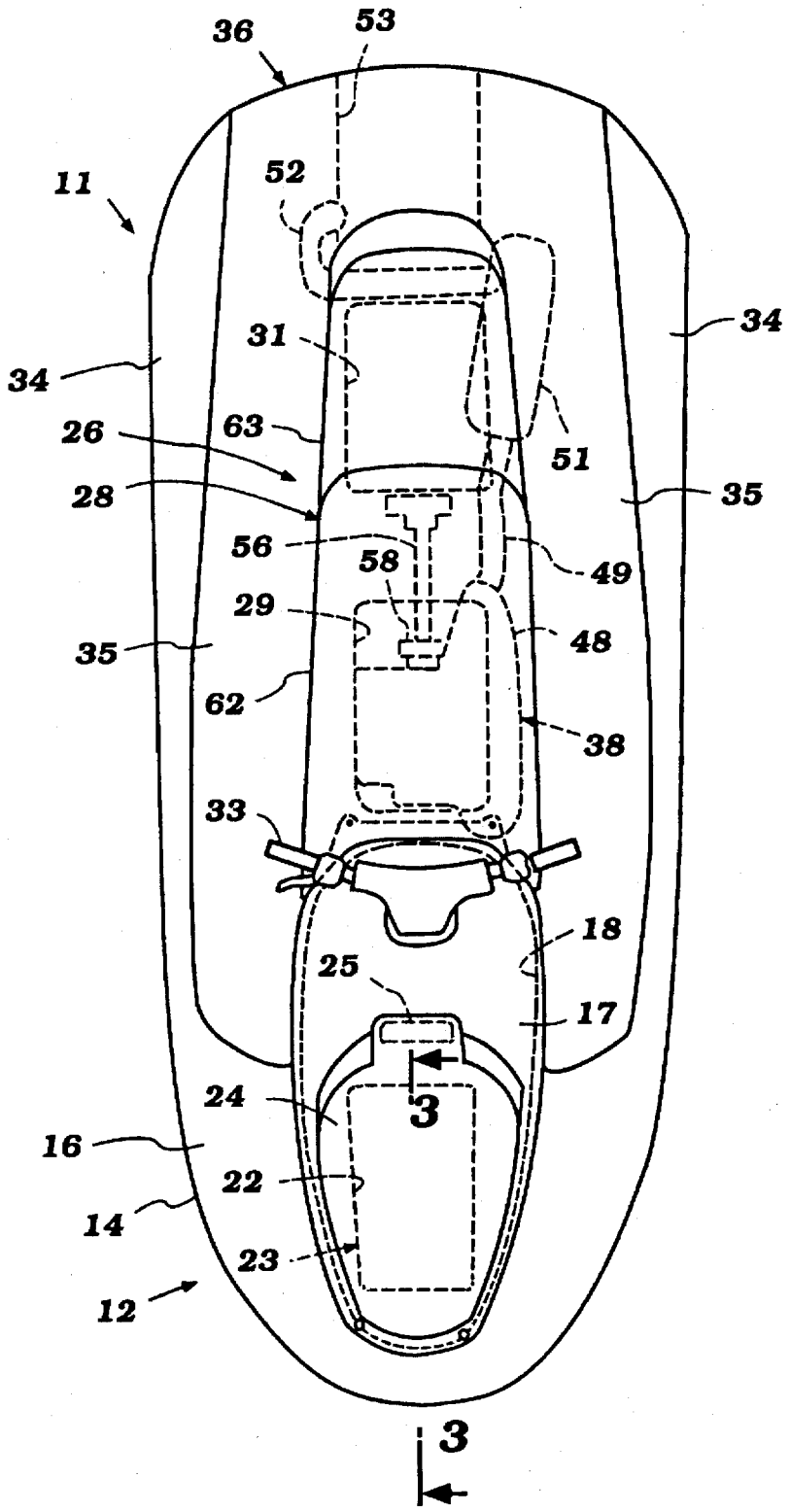
FIG. 1 is a top plan view of a personal watercraft constructed in accordance with an embodiment of the invention.

Referring now in detail to the drawings and initially to FIGS. 1 through 4, a personal watercraft constructed in accordance with an embodiment of the invention is identified generally by the reference numeral 11. The watercraft 11 is comprised of a hull indicated generally by the reference numeral 12 and comprised primarily of a lower hull portion 13 and an upper deck assembly 14 which may be formed from any suitable material, such as a molded fiberglass reinforced resinous plastic, or the like.

Figure 4:
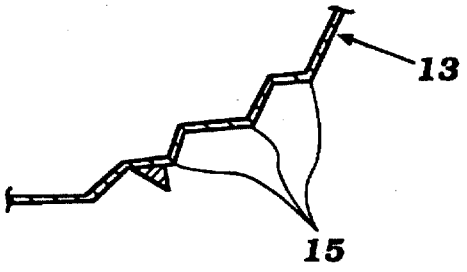
FIG. 4 is a cross-sectional view taken along the line 4—4 of FIG. 2 showing a portion of the lower hull.

As seen in FIG. 4, which is a cross sectional view of a portion of the lower hull 13, the lower hull 13 is configured with a series of steps 15 which extend longitudinally towards the rear of the watercraft 11 and serve to enhance the performance of and stabilize the watercraft 11 in the body of water in which the watercraft 11 is operating. The forward most portions of the steps are configured to reduce the upward splashing of the water to protect the riders.

The upper deck assembly 14 is comprised of a main deck portion 16 and a forward engine removal closure assembly 17. The main deck portion 16 sealingly engages the lower hull 13 around its periphery in any suitable manner and has a large opening normally closed by the closure assembly 17. This opening is henceforth referred to as the replacement access opening and is indicated by the reference numeral 18.

Figure 3:
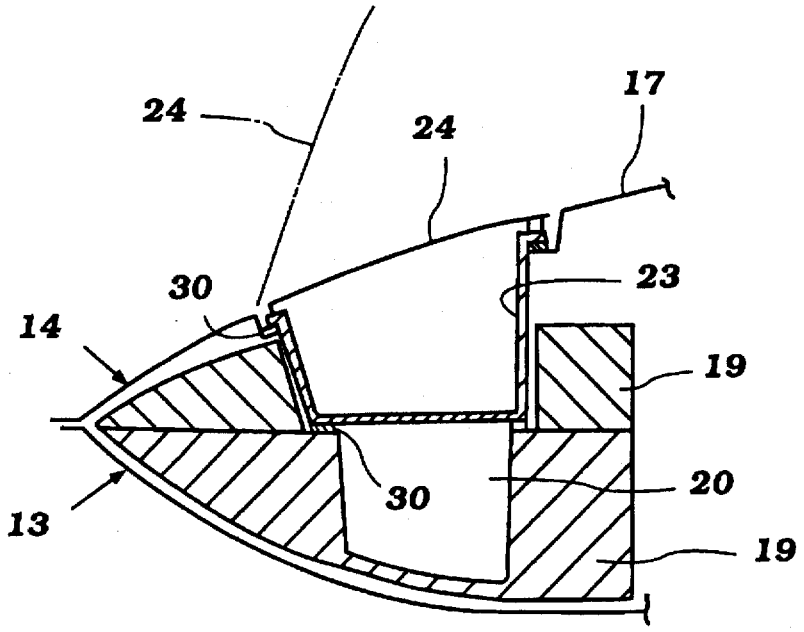
FIG. 3 is a cross-sectional view taken along the line 3—3 of FIG. 1 showing the front portion of the watercraft.

As is seen in FIG. 3, a number of floatation bodies, indicated by the reference numeral 19, are disposed inside the front portion of the hull 12 immediately below the engine hatch or closure assembly 17. These flotation bodies are formed from segments that are sized to be inserted and removed through the replacement access opening 18 when the hatch 17 is removed.

Figure 2:
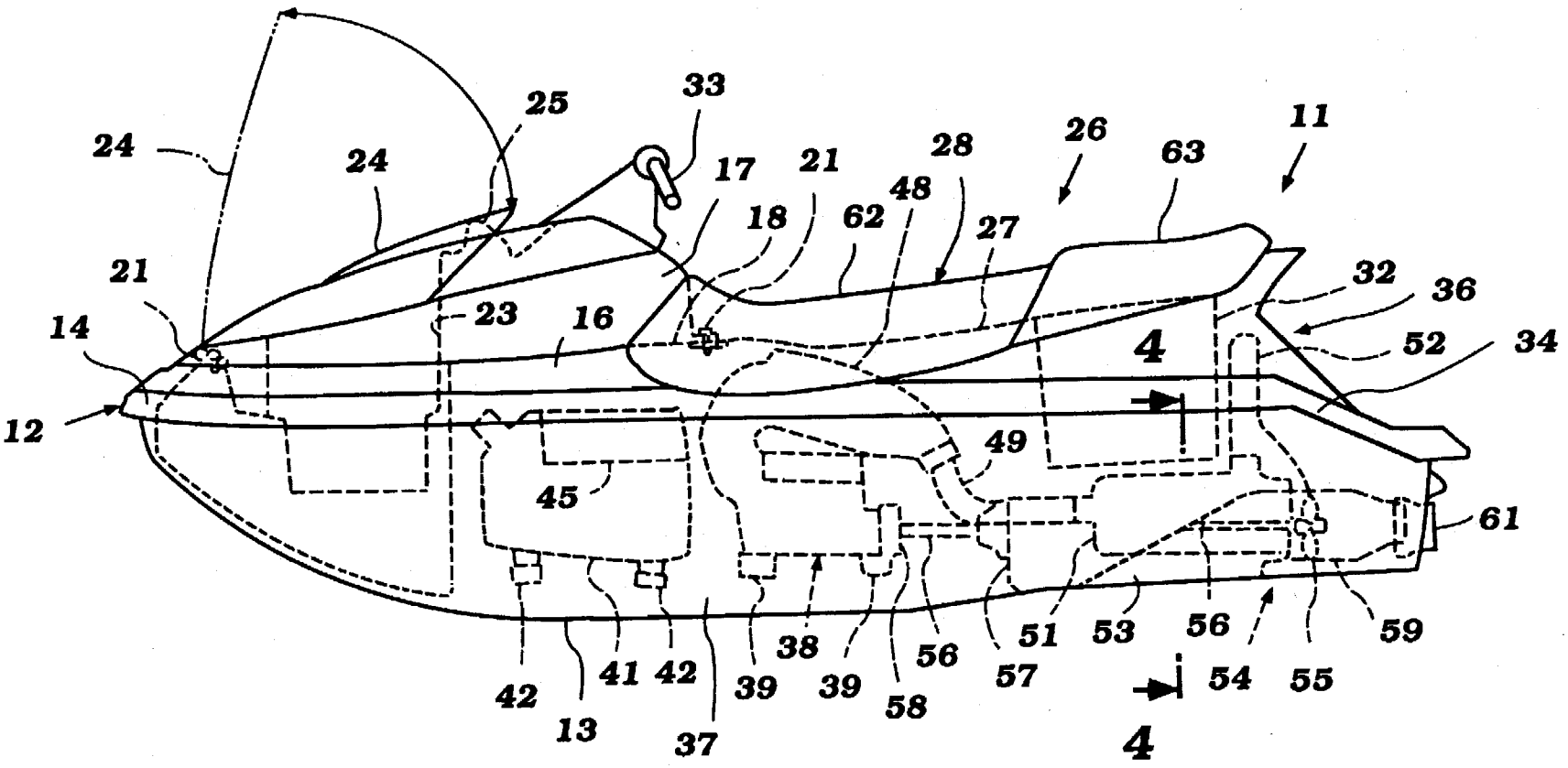
FIG. 2 is a side elevational view thereof.

The engine hatch assembly 17 sealingly engages the main deck portion 16 at its forward end around the periphery of the replacement access opening 18 and is held in position by the bolts 21 as best seen in FIG. 2. The hatch assembly 17 has an opening at its rearward end through which a control mast (not shown) for control of the watercraft 11 extends.

As best seen in FIGS. 1 and 2, the engine hatch assembly 17 also has an access opening 22 in which is removably mounted by any suitable means a storage compartment forming member 23. The storage opening formed by the member 23 is sealed and closed by a closure or hatch 24. The hatch 24 is pivotally connected to the engine hatch assembly 17 at its forward end for movement from its closed position shown in solid lines to an opened position as shown in phantom in FIGS. 2 and 3. A suitable latch acts along the rearward edge of the cover to maintain it in its closed position. Adjacent this latch is a handle 25 for the easy opening of the cover 24.

The portion of the flotation body 19 beneath the storage forming member 23 is formed with an opening 20 which can either serve as another storage compartment or may house and protect an engine auxiliary such as a fuel tank. This opening 20 may be easily accessed by removing the storage compartment forming member 23. Seals 30 seal the opening 20 and the storage compartment formed by the member 23 through cooperation with the member 23.

The main deck portion 16 of the upper deck assembly 14 has a rider's area formed at its rearward end that is indicated by the reference numeral 26 and is composed of a longitudinally extending raised seat portion 27 to which is mounted in a manner to be described later a padded seat cushion assembly 28 for accommodating one or more riders seated in straddle, tandem fashion.

Figure 5:
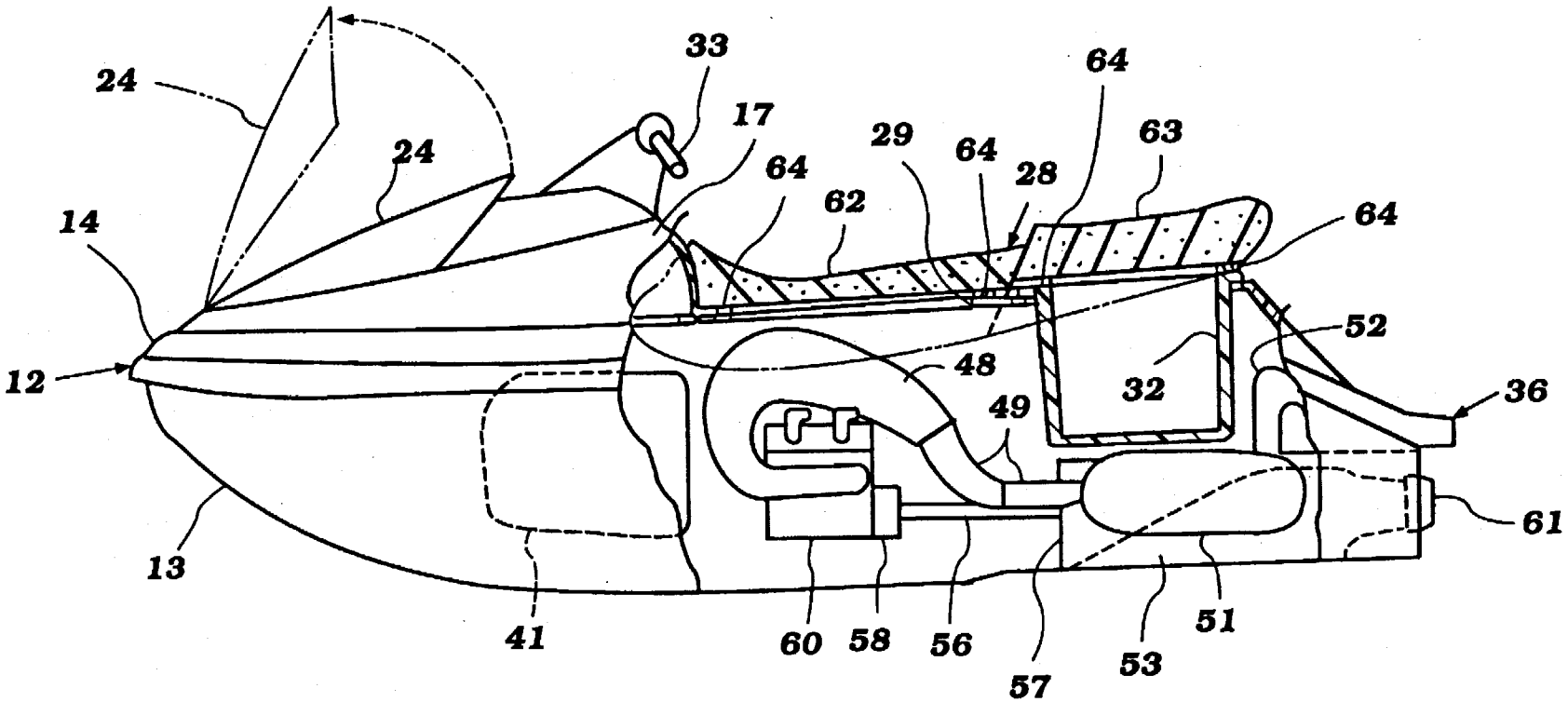
FIG. 5 is a side elevational view of a watercraft constructed in accordance with another embodiment of the invention, in part similar to FIG. 2, with portions of the exterior surfaces broken away and shown in section to show the location of the various components of the engine compartment.
Figure 6:
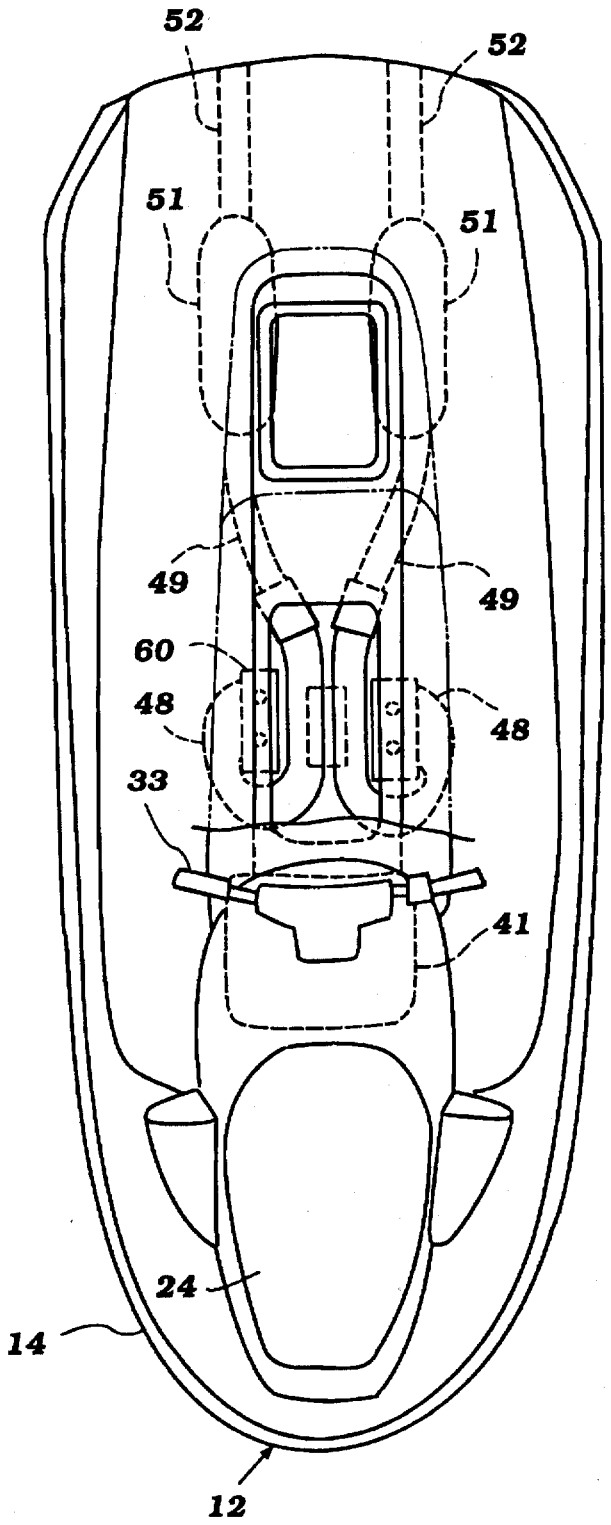
FIG. 6 is a top plan view of this embodiment of the invention.

A first opening, namely a service access opening that is indicated by the reference numeral 29, is disposed at the forward top portion of the raised seat portion 27 of the rider's area 26 underneath the front of the seat cushion assembly 28. A further storage access opening 31 is disposed at the rearward top portion of the raised seat portion 27 behind the service access opening 29 and underneath the upper rear of the seat cushion assembly 28 into which a detachable rear storage box like compartment indicated by the reference numeral 32 and having a construction as shown in the embodiment of FIGS. 5 and 6 is positioned.

Controls for operating the watercraft 11 are disposed forwardly of the seat cushion assembly 28 and include a handlebar assembly 33 which is connected to the aforenoted control mast and controls the steering of the watercraft 11 in a known manner and may additionally include a throttle control for the powering internal combustion engine, to be described.

The outer periphery of the riders area 26 is defined by a pair of raised gunnels 34. These gunnels 34 are formed at opposite sides of the rear portion of the upper deck assembly 14 and define the outer extremities of a pair of foot areas 35 into which the riders may place their feet. The rear of the foot areas 35 are opened through the rear of a transom 36 to facilitate water drainage and also to permit ease of entry and exit of the watercraft 11 from the body of water in which the watercraft 11 is operating.

The hull 12 defines an engine compartment that is indicated by the reference numeral 37 and at whose lower surface an internal combustion engine 38 is mounted by means of mounting pads 39 underneath the forward portion of the rider's area 26. The engine 38 forms a portion of the propulsion system for the watercraft 11 and may be of any known type. In this embodiment, the engine is of the in-line type, but as will become apparent from the description of the next embodiment, the invention facilitates the use of V-type engines.

Fuel is supplied to the engine 38 from a fuel tank 41 which is mounted in the hull 12 in front of the engine 38. The fuel tank 41 is mounted by means of mounting blocks 42 and may be filled at the front of the watercraft 11 as will be described later by reference to the embodiment shown in FIGS. 7 through 9.

In the specific construction shown in this embodiment, the engine 38 operates on a two cycle principle. Thus oil is supplied to the engine 38 for its lubrication from an oil tank 45 that is formed integrally to the fuel tank 41 and is filled in a manner as will also be described by reference to FIGS. 7–9.

The engine 38 has an exhaust system which exhausts the combustion products to the atmosphere. A combined exhaust manifold and expansion chamber 48 cooperates with the exhaust ports of the engine 11. The manifold and expansion chamber 48 turns upwardly at its forward end and then turns rearwardly toward the rear portion of the engine 38 and on one side of a longitudinal plane of the watercraft 11.

At its rearward end, the exhaust manifold and expansion chamber 48 is connected to a transfer pipe 49 which, in turn, discharges into a water trap device 51. A cross-over pipe 52 conveys the exhaust gasses from the water trap device 51 upwardly and transversely across and underneath the rearmost portion of the seat 28 and terminates at a discharge end formed in the side of a tunnel 53.

As is common in watercraft, the engine 38 is water cooled. Cooling water is drawn in any known manner from the body of water in which the watercraft 11 is operating and circulated through the cooling jackets of the engine 38. This water may also cool the exhaust system as described through additional cooling jackets.

At some time this water or a portion of it is discharged into the exhaust system. The configuration of the exhaust system described and the water trap device 51 assist in insuring that this water will not enter the engine through the exhaust system even if the watercraft 11 is capsized and subsequently righted. Also the discharge end of the exhaust system may be below or close to the water level. The exhaust system is designed to also prevent water from the body of water in which the watercraft 11 is operating to enter the engine 38.

The tunnel 53 is formed on the underside of the lower hull portion 13 at its rearward end and opens through the rear of the transom 36. A jet propulsion unit indicated by the reference numeral 54 is mounted within the tunnel 53 for propelling the watercraft 11. This jet propulsion unit 54 is a further portion of the watercraft propulsion system. The jet propulsion unit 54 includes an impeller 55 which draws water from the body of water in which the watercraft 11 is operating through a downwardly facing inlet opening in the underside of the hull portion 14. The impeller 55 is affixed to an impeller shaft 50 which extends forwardly and is driven from the engine 38 by a transmission that is primarily comprised of a drive shaft which extends forwardly through a bulkhead 57 from the tunnel 53 into the engine compartment 37. The drive shaft 56 is coupled by means of a flexible coupling 58 to the engine output shaft (not shown) for driving the impeller 55.

Water pumped by the impeller 55 is discharged rearwardly through an opening formed at the rear of the tunnel 53 in the transom 36 through a discharge nozzle portion 59 of the jet propulsion unit 54. A pivotally supported steering nozzle 61 is supported in registry with the discharge nozzle 59 and is steered by the handlebar assembly 33 for steering of the watercraft 11 in a well known manner.

As stated previously, the engine 38 is mounted inside the engine compartment 37 underneath the rider's area 26 and specifically below the service access opening 29. During the course of normal vehicle maintenance the engine 38 or those of its components that require periodic maintenance or service can be accessed through the service access opening 29. Such engine components may be the spark plugs and other components of the ignition system, the carburetor or carburetors or fuel injectors and like components.

However, it will at times be necessary to remove the engine 38 from the watercraft 11. It is not possible, however, to remove the engine 38 from the watercraft 11 through the service access opening 29 since the service access opening 29 is not large enough to permit an assembled engine to pass through it. If complete removal of the engine is necessary, this is possible through the use of the replacement access opening 18.

The engine 38 is removed in the following manner with reference to FIG. 2. The engine hatch assembly 17 is removed along with the handlebar assembly 33 from the top of the main deck 16 by loosening the bolts 21. Any fuel and oil connections are disconnected from the respective conduits, while the engine hatch assembly 17 is still in close proximity to the exposed replacement access opening 18.

With the engine hatch assembly 17 fully removed from the watercraft 11 the floatation bodies 19 can then be removed through the replacement access opening 18. After loosening the fuel tank 41 from its mounting blocks 42 and disconnecting any remaining connections the fuel and oil tanks 41 and 45 may be easily removed from the hull 12 which allows the rider to next loosen the engine 38 from its mounting pads 39.

Once the engine output shaft is disconnected from the drive shaft 56, the engine 38 and the combined exhaust manifolds and expansion chambers 48 may be slid forward and removed from the hull 12 through the replacement access opening 18 as a unit. Alternately the combined exhaust manifolds and expansion chambers 48 may be loosened and separated from the engine 38 through the service access opening 29 prior to removing the engine 38.

Thus, it is readily apparent that the engine 38 is completely accessible to the rider for those maintenance purposes which require the removal of the engine 38 from the watercraft 11 and can also be accessed by the rider through the service access opening 29 for those routine maintenance operations which can be expedited without requiring the removal of the engine 38, such as changing the spark plugs or the like.

The padded seat cushion assembly 28 and its mounting to the raised seat portion 27 of the main deck 16 will now be described in detail. It is necessary to remove the seat cushion assembly 28 in order to gain access to both the service access opening 29 and also to the detachable storage compartment 32. Since the need to access one or both of these areas is likely to occur with regularity, the seat cushion assembly 28 may be removed both quick and easy. To facilitate this the seat cushion 28 is divided into two separate portions. This avoids the necessity to handle a single heavy and cumbersome component. In addition it is also possible that the rider may require access to the storage compartment 32 while seated atop the seat cushion assembly 28 or to service the engine 38 while seated. This invention meets both of these requirements by splitting the seat cushion assembly 28 in two and securely but detachably mounting each half to the raised seat portion 27 in a manner that is easy to remove and requires no tools.

The seat cushion assembly 28 is split into forward and rearward seat cushions that meet slightly forward of the storage compartment 32, and are indicated by the reference numerals 62 and 63, respectively. The front seat cushion 62 sealingly engages the periphery of the service access opening 29 and serves as a removable closure therefor This cushion 62 is detachably locked in place by means of a suitable locking mechanism of any type known in this art. A seal 64 provides a water tight seal for the service access opening 29 when the forward seat cushion 62 is locked in place.

Figure 7:
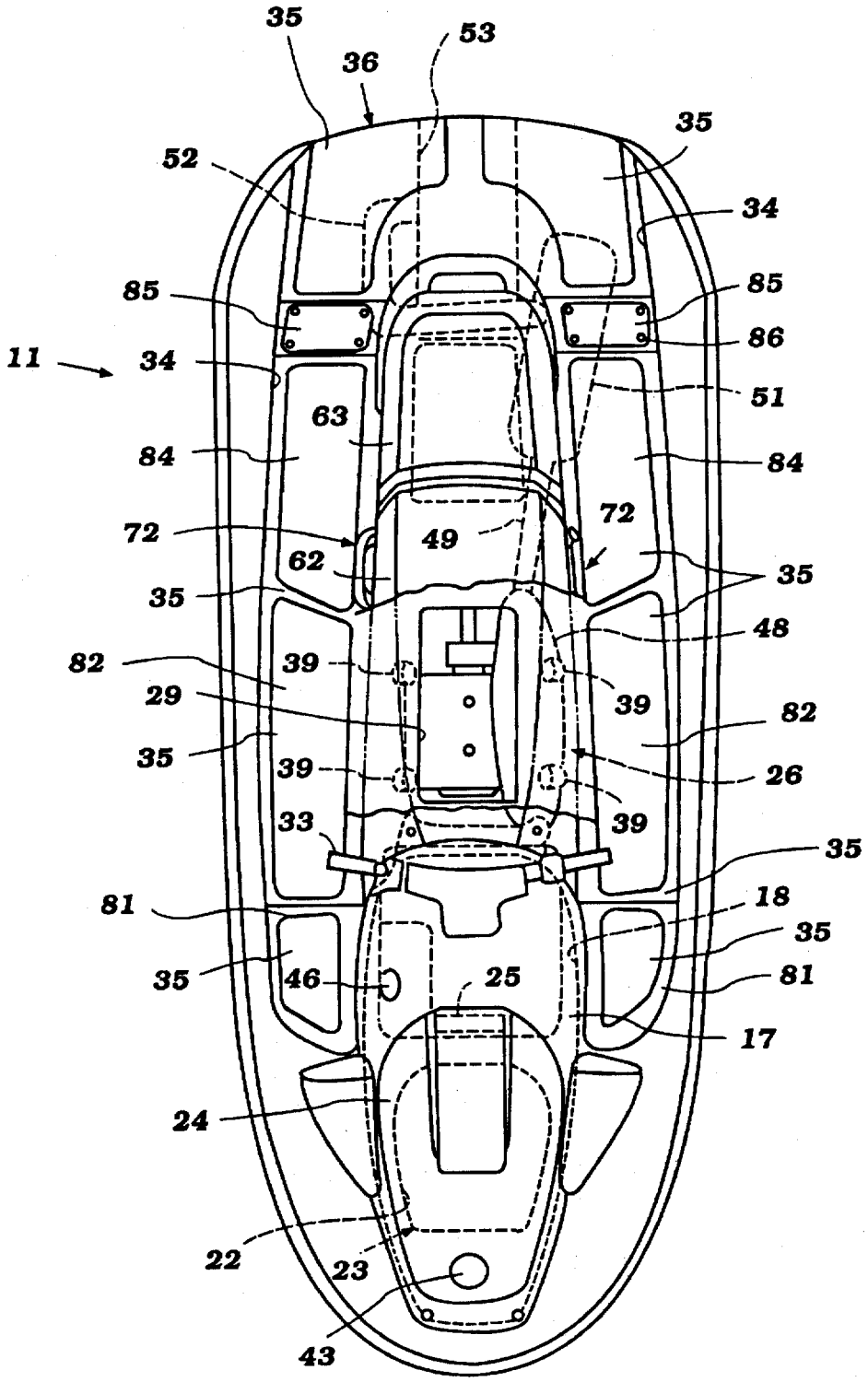
FIG. 7 is a top plan view, in part similar to FIGS. 1 and 6, of another embodiment of personal watercraft.
Figure 8:
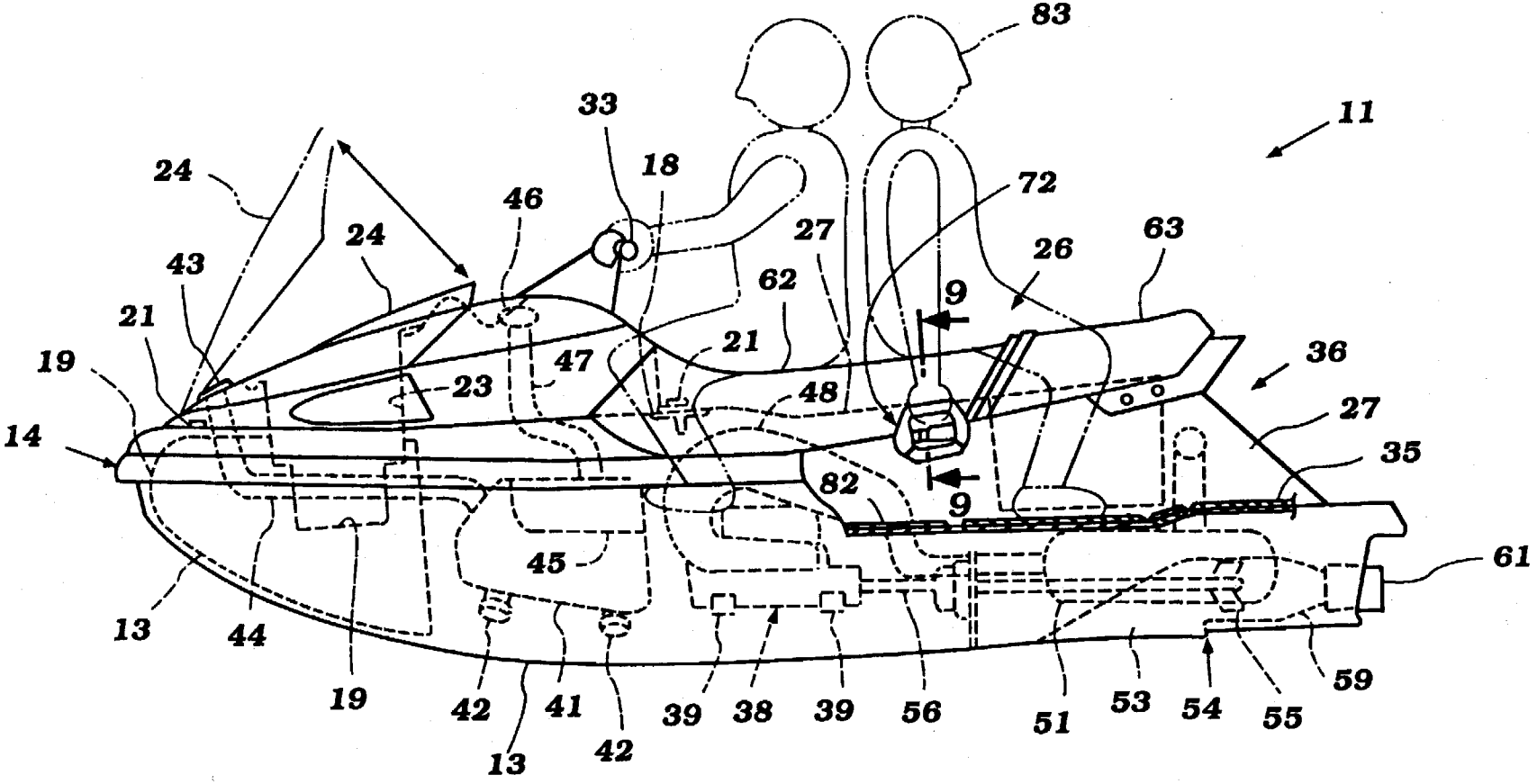
FIG. 8 is a side elevational view, in part similar to FIGS. 2 and 5 and shows another embodiment and an alternate seating position.
Figure 9:
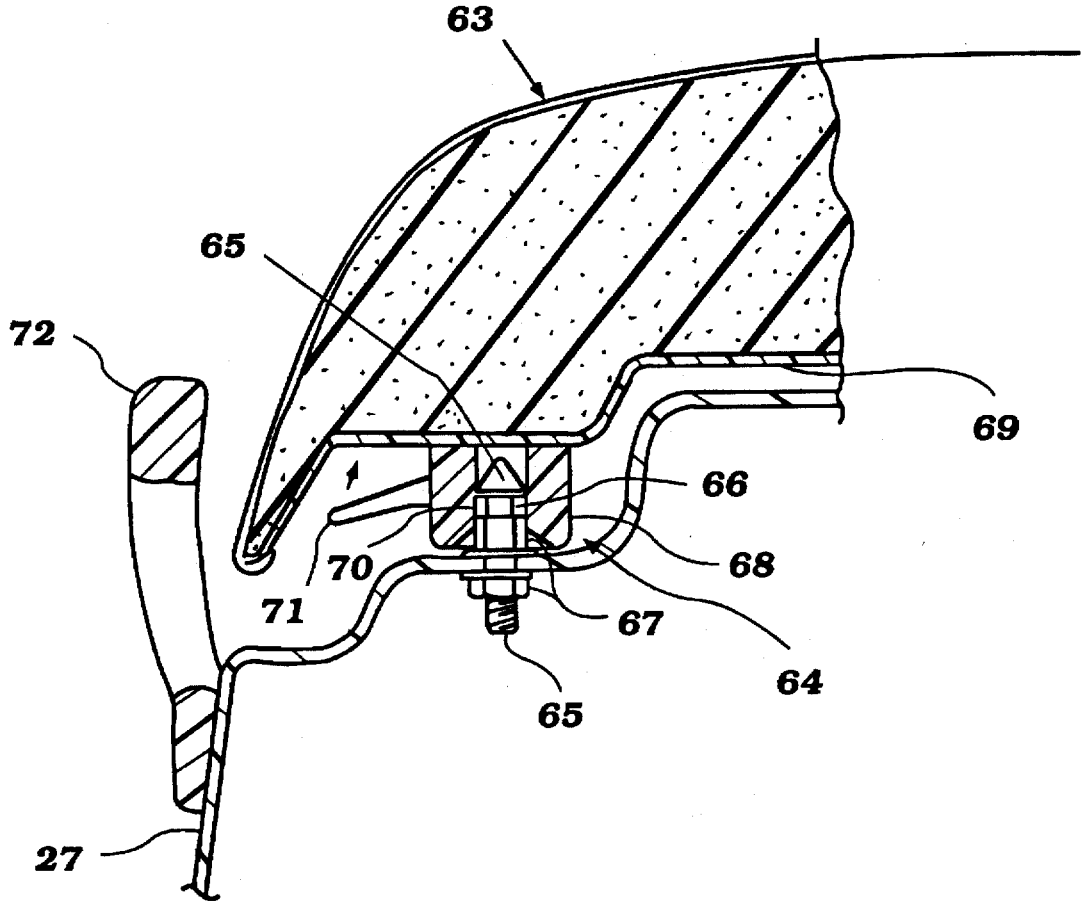
FIG. 9 is a cross-sectional view taken along the line 9—9 of FIG. 8.

In like manner, the rear seat cushion 63 sealingly engages the periphery of the rear storage access opening 31 and is mounted to the main deck 16 by forward and rearward pairs of locking mechanisms of a type that will be described in more detail by reference to a later embodiment (FIGS. 7–9). It should be noted that the rear cushion 63 is disposed at a higher level than the front cushion 62. Thus the passenger will be more comfortable because his forward vision is less obstructed.

A seal 64 is also carried by the underside of the seat cushion 63 to seal the storage compartment 31 when the seat cushion 63 is locked in place.

In the embodiment thus far described the engine illustrated was of the in-line type. Such engines permit a narrow seat and seat base. However in order to keep good fore and aft balance and to provide more power, the use of V-type engines. The invention permits the use of such engines without excessively widening the seat, as would be required if the engine were lifted directly upwardly from its mounted position.

FIGS. 5 and 6 show an embodiment which is the same as that of FIGS. 1–4, but which embodies a V-4 engine, indicated by the reference numeral 60. Except for this difference the construction is the same. Thus the same components have been identified by like reference numerals.

The engine 60 has a pair of angularly related cylinder banks each of which has its exhaust ports disposed on the respective outer side of the bank. An exhaust system as generally described serves each bank and each system discharges to the atmosphere through a respective outlet or discharge end. Each system has an exhaust manifold and expansion chamber device 48.

Each of these devices 48 discharge through pipes 49 to a respective water trap device 51 disposed on the respective side of the tunnel 53. Unlike the previous embodiment, however, the water trap devices discharge the exhaust gasses to the atmosphere on the same respective sides of the tunnel 53. Thus the exhaust pipes 52 do not cross over the tunnel and have the trap sections as with the previous embodiment. Of course, that feature could also be employed with V-type engines if desired.

It should be readily apparent to those skilled in the are how the engine 60 of this embodiment may be removed and replaced. The method is basically the same as that already described.

In the embodiments thus far described the added passenger may sit in straddle tandem position with the rider, operator. The passenger faces in the same direction as the riser operator. Thus the rear seat cushion 63 is elevated relative to the front cushion 62. In this way the passenger has a forward view. When no passenger is carried, the rider may shift rearwardly onto the cushion 63 if he desires.

Next will be described an embodiment where the passenger may sit in a rearwardly facing fashion, although that is possible with the embodiments already described. This embodiment also shows in detail a type of latch which may be used to secure the rear seat cushion 63 in place. Such a latching mechanism may also be used for the front cushion 62.

The locking mechanisms 64 will now be discussed in detail by primary reference to FIG. 9. The locking mechanism 64 is composed of a receiving bolt or keeper 65 that has a notched portion 66. The keeper 65 is mounted to the raised seat portion 27 of the main deck 14 and is held in position by nuts 67 which threadingly engage a threaded portion of the keeper 65 on both the top and bottom sides of the raised seat portion 27 of the riders area 26.

A collar or shroud 68 is affixed to a backing plate 69 which forms the lower surface of the seat cushion 62. A lever 71 is pivotally connected to the collar 68 and partially extends into the open central area of the collar 68. The lever 71 operates a slidable retainer 70 which releasably engages the notched portion 66 to lock the cushion 63 in place. The seat cushion 62 may be easily removed by simply pushing each lever 71 upwards which to remove the respective keeper from the notch 66 and, thus, unlock the locking mechanism 64.

As has been noted, this embodiment facilitates the passenger sitting in a rearwardly facing posture. To offer comfort for such a rearwardly facing seating position, a pair of grab handles, indicated by the reference numeral 72 are mounted to the sides of the raised seat portion 27 of the rider's area 26 such that a passenger may securely straddle the rider's area 26 while facing rearwardly with his hands grasping the grab handles 72. The grab handles also protect the seat latch releasing levers from inadvertent release.

The rider's floor area is provided with a pair of anti-skid surfaces 81 and 82 on which the rider/operator may place his feet. The rear passenger, indicated as 83 may place his feet on anti-skid surfaces 84 regardless of whether facing forwardly of rearwardly. For additional bracing if facing rearwardly there are inclined surfaces having replaceable wear plates 85. These wear plates 85 are fixed in place by screws 86.

This embodiment also shows in more detail the way in which the fuel tank 41 and lubricant tank 45 may be filled. This can be done without opening any of the hatch covers. The fuel tank 41 is provided with a forwardly extending fill pipe 44 as seen in FIG. 8. This pipe turns upwardly at the front cowling portion 16 and presents an externally accessible fill neck closed by a cap 43.

The oil tank 45 has a fill pipe that extends transversely to a fill neck surrounded by the hatch cover 17. A fill cap 46 is detachably received on this fill neck. Because The oil and fuel fill openings are spaced from each other, the chance of the operator putting the wrong fluid in the tank being filled is minimized.

Figure 10:
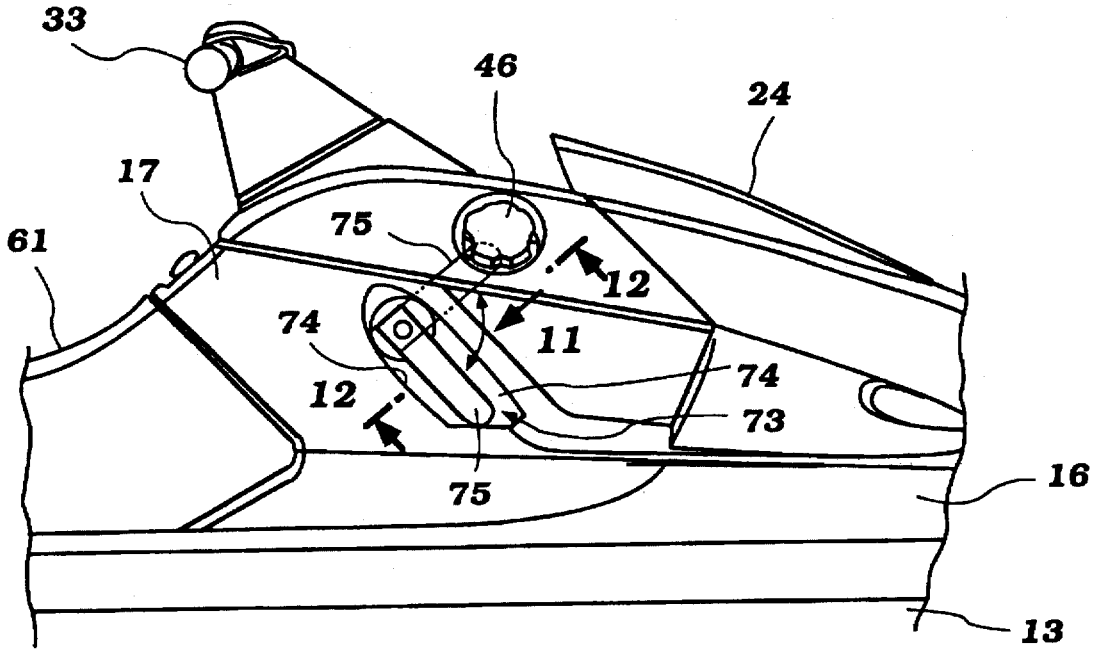
FIG. 10 is a side elevational view of a portion of a watercraft showing an arrangement for reverse thrust bucket control that may be utilized with any of the illustrated embodiments.
Figure 11:
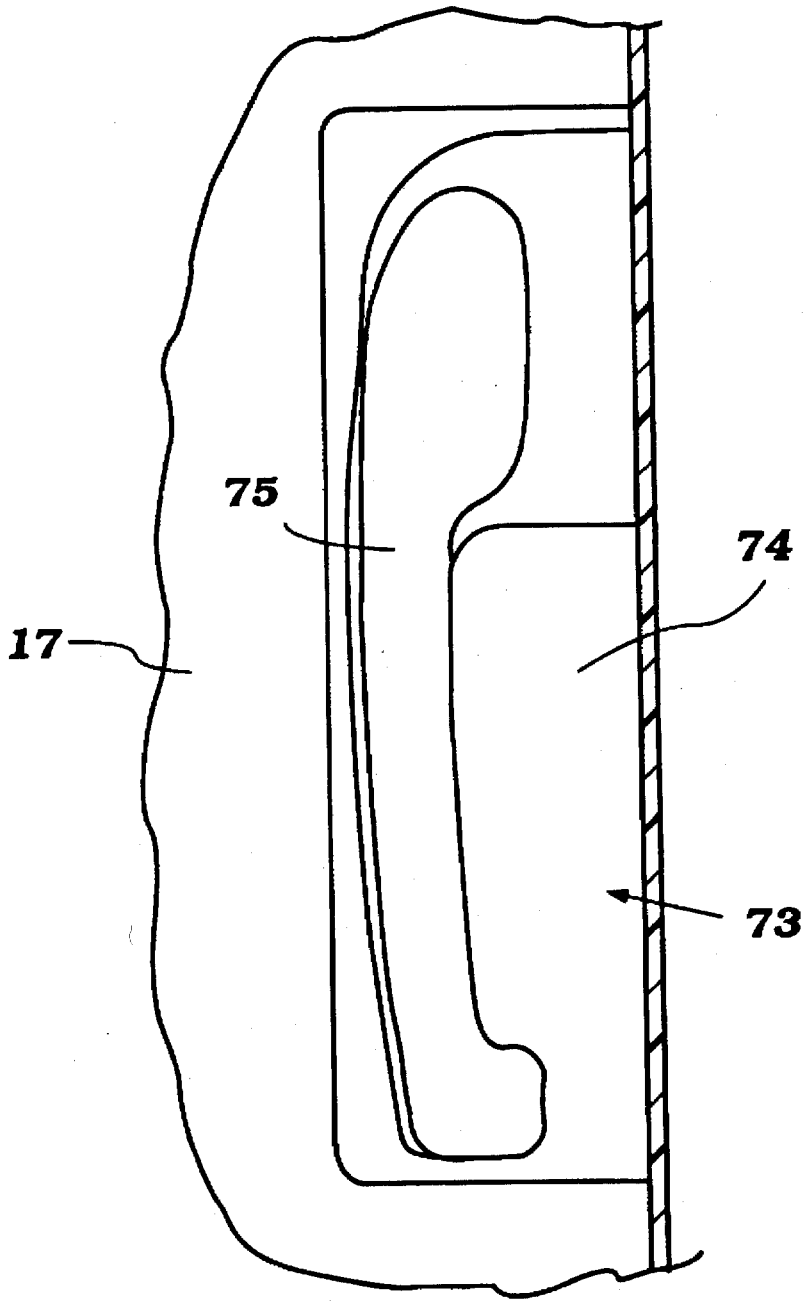
FIG. 11 is an enlarged view taken along line 11 of FIG. 10.
Figure 12:
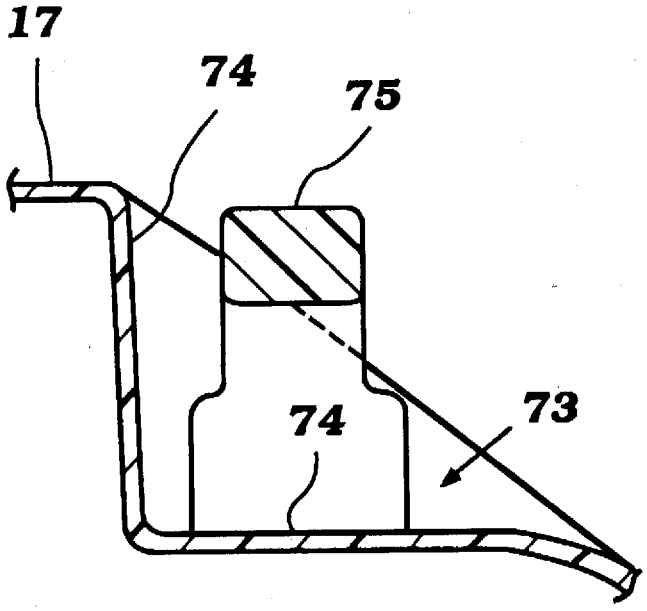
FIG. 12 is a cross-sectional view of the embodiment of FIG. 10 taken along line 12—12 of FIG. 10.

FIGS. 10, 11 and 12 illustrate a further embodiment of the invention in which a reverse propulsion engagement mechanism that is indicated generally by the reference numeral 73 is disposed within a recess 74 formed along the side of the engine hatch assembly 17. The mechanism 73 is composed of a handle 75 that is rotatably journaled within the engine hatch assembly 17. At its end that is inside the engine assembly 17, the handle 75 is detachably connected to a transmission linkage assembly such as a bowden wire actuator (not shown) which, in turn, is connected at its opposite end to a reverse actuating mechanism such as a reverse thrust bucket of any known type which cooperates with the steering nozzle 61 to generate a reverse thrust, when desired.

It should be readily apparent from the foregoing description that the described embodiments of the invention provide very compact and yet highly serviceable and usable personal watercraft. Of course, the foregoing description is that of the preferred embodiments of the invention and various changes and modifications may be made without departing from the spirit and scope of the invention, as defined by the appended claims.

What is claimed is:

1. A small watercraft comprised of a hull, said hull defining a rider's area having a raised seat portion adapted to accommodate at least one rider, an engine compartment formed in said hull at least in part beneath said raised seat portion, an internal combustion engine supported in said engine compartment, a propulsion device for propelling said hull supported said hull and driven by said internal combustion engine, said seat portion being formed with a service access opening through which at least one component of said engine may be accessed for servicing, a first removable closure detachably covering said service access opening, said service access opening not being large enough to pass said internal combustion engine as a unit therethrough, a further replacement access opening formed in said hull at a location spaced from said service access opening and through which said internal combustion engine may be removed as a unit, and a second removable closure for closing said replacement access opening.

2. A small watercraft as set forth in claim 1, wherein the second removable closure also forms a storage compartment.

3. A small watercraft as set forth in claim 2, wherein the storage compartment formed by the second removable closure is also provided with an access opening and further including a third removable closure for closing said storage compartment access opening.

4. A small watercraft as set forth in claim 3, wherein the third removable closure is movably supported by the second removable closure for movement between a closed position closing the storage compartment opening in an open position.

5. A small watercraft as set forth in claim 4, wherein the third removable closure is pivotally supported by the second removable closure.

6. A small watercraft as set forth in claim 2, wherein the engine compartment extends at least in part under the second removable closure and further including an engine accessory positioned under and accessible through the second removable closure and replacement access opening.

7. A small watercraft as set forth in claim 6, wherein the other engine accessory must be removed before the engine can be removed through the replacement access opening.

8. A small watercraft as set forth in claim 7, wherein the engine accessory comprises a liquid tank for holding a liquid utilized by the engine.

9. A small watercraft as set forth in claim 8, wherein the liquid tank comprises an oil tank for holding lubricant for the engine.

10. A small watercraft as set forth in claim 8, wherein the liquid tank holds fuel for the engine.

11. A small watercraft as set forth in claim 8, wherein there are two liquid tanks positioned beneath the second removable closure, one of which is a fuel tank for supplying fuel to the engine.

12. A small watercraft as set forth in claim 11, wherein the other liquid tank comprises an oil tank for lubricant for the engine.

13. A small watercraft as set forth in claim 8, wherein the liquid tank is supported adjacent a floatation body for adding to the floatation of the watercraft.

14. A small watercraft as set forth in claim 13, wherein the floatation body must also be removed for removal of the engine through the replacement access opening.

15. A small watercraft as set forth in claim 1, wherein the raised seat portion extends longitudinally through the rider's area and has a pair of foot areas on opposite sides thereof so that a rider may sit on the raised seat portion in straddle fashion.

16. A small watercraft as set forth in claim 15, wherein the raised seat portion extends longitudinally a sufficient distance to provide either two different seating positions for a rider and to accommodate two riders seated in straddle tandem fashion.

17. A small watercraft as set forth in claim 16, wherein the first removable closure comprises a removable portion of a seat cushion detachably connected to the raised seat portion.

18. A small watercraft as set forth in claim 17, further including a control for the watercraft positioned to the front of the raised seat portion.

19. A small watercraft as set forth in claim 18, wherein the service access opening is formed at the forward portion of the raised seat portion and adjacent the control.

20. A small watercraft as set forth in claim 17, wherein the seat further includes a second removable seat cushion portion.

21. A small watercraft as set forth in claim 20, further including a storage compartment formed beneath enclosed by the second removable seat cushion portion.

22. A small watercraft as set forth in claim 20, wherein the service access opening is closed by the forwardmost removable seat portion.

23. A small watercraft comprised of a hull, said hull defining a rider's area having a longitudinally extending raised seat portion adapted to accommodate at least one rider seated thereon in straddle fashion, a pair of foot areas formed on opposite sides of said raised seat portion on which a seated rider may place his feet, a propulsion system for said watercraft comprised of an internal combustion engine, a propulsion device for propelling said hull and a transmission for driving said propulsion device from said engine, at least a portion of said propulsion system being disposed beneath said raised seat portion, an access opening formed in a upper surface of said raised seat portion through which at least a portion of said propulsion system may be accessed, a further opening formed in said upper surface of said raised seat portion for accommodating a storage compartment, a first seat cushion detachably connected to said raised seat portion and forming a closure for said access opening, and a second seat cushion detachably connected to said raised seat portion for forming a closure for said further opening.

24. A small watercraft as set forth in claim 23, wherein the first and second seat cushions are adjacent to each other when detachably connected to the raised seat portion so as to form a continuous seating area.

25. A small watercraft as set forth in claim 24, wherein the rearward most seat cushion is disposed at a higher level than the forward most seat cushion.

26. A small watercraft as set forth in claim 23, further including a control for the watercraft positioned to the front of the raised seat portion.

27. A small watercraft as set forth in claim 26, wherein the service access opening is formed at the forward portion of the raised seat portion and adjacent the control.

28. A small watercraft as set forth in claim 27, wherein the storage compartment is formed by a box shaped member that is fixed relative to the hull and which has an open upper end closed by the second seat cushion.

29. A small watercraft as set forth in claim 28, wherein the box like member is readily removable from the hull.

30. A small watercraft as set forth in claim 29, wherein a further portion of the propulsion system may be accessed when the box like member is removed from the hull.

* * * * *